US005791463A

United States Patent [19]

Negelen

[11] Patent Number: 5,791,463

[45] Date of Patent: Aug. 11, 1998

[54] HOLDING ARRANGEMENT FOR CANS

[75] Inventor: Emanuel Negelen, Schweich, Germany

[73] Assignee: Riverwood International Corporation, Atlanta, Ga.

[21] Appl. No.: 741,401

[22] Filed: Oct. 29, 1996

Related U.S. Application Data

[63] Continuation of Ser. No. 387,861, Apr. 24, 1995, abandoned.

[30] Foreign Application Priority Data

Aug. 14, 1992 [GB] United Kingdom ..... 9217271

[51] Int. Cl.[6] ..... B65D 85/62

[52] U.S. Cl. ..... 206/147; 206/159; 206/427

[58] Field of Search ..... 206/145, 147, 206/151, 153, 159, 427

[56] References Cited

U.S. PATENT DOCUMENTS

| | | | |
|---|---|---|---|
| 2,330,699 | 9/1943 | Flamm | 206/147 X |
| 3,442,547 | 5/1969 | Skillen | 206/153 X |
| 4,190,149 | 2/1980 | Oliff et al. | 206/147 X |
| 4,273,273 | 6/1981 | Zenri | 206/145 X |
| 5,127,519 | 7/1992 | Tsao | 206/151 X |
| 5,135,104 | 8/1992 | Jorba | 206/151 |
| 5,188,225 | 2/1993 | Jorba | 206/145 |
| 5,311,994 | 5/1994 | Oliff | 206/158 X |

FOREIGN PATENT DOCUMENTS

| | | |
|---|---|---|
| 38438/63 | 12/1963 | Australia . |
| 15940/70 | 6/1970 | Australia . |
| 32855/71 | 8/1971 | Australia . |
| 14008/76 | 4/1976 | Australia . |
| 55524/90 | 4/1990 | Australia . |
| 21564/92 | 5/1992 | Australia . |
| 34582/93 | 2/1993 | Australia . |
| 346693 | 12/1989 | European Pat. Off. . |
| 2363493 | 3/1978 | France . |
| 2037246 | 2/1971 | Germany . |
| 6612684 | 8/1967 | Netherlands . |
| 2108465 | 5/1983 | United Kingdom . |
| 2170774 | 8/1986 | United Kingdom . |

*Primary Examiner*—Jacob K. Ackun
*Attorney, Agent, or Firm*—Isaf, Vaughan & Kerr

[57] ABSTRACT

A paperboard carrier device for holding a plurality of article containers, each article container having an annular rim formed along an upper peripheral edge extending perpendicularly with respect to an article container sidewall, is disclosed. The carrier device includes a top panel (11) having a plurality of spaced article engaging apertures (12) defined therein and extending therethrough. Each aperture is dimensioned to be less than the rim diameter of the article containers, and has a continuous marginal portion (31) sized and shaped to elastically deform as it is passed over the annular rim of one of the article containers and is received on the sidewall of the article container and engaged in a snap fit beneath the annular rim thereof. A pair of spaced and opposed web panels (41, 42) are hingedly connected to a pair of spaced side edges at the top panel along a first pair of hinge lines (43, 44), and are constructed and arranged to be folded upwardly along each of the hinge lines toward the upper peripheral edges of the article containers. A main overpanel (45) is hingedly connected to one of the web panels along one of a second pair of spaced and opposed hinge lines (46, 48), and is constructed and arranged to be folded along one of the second hinge lines over onto and across the annular rims of the article containers. A secondary overpanel (47) is hingedly connected to the other one of the second hinge lines, and is constructed and arranged to be folded along the hinge line into engagement with at least a portion of the main overpanel and to be fastened thereto so that the carrier device encloses the tops of the article containers (35).

8 Claims, 3 Drawing Sheets

HOLDING ARRANGEMENT FOR CANS

This is a continuation of application Ser. No. 08/387,861 filed on Apr. 24, 1995 and now abandoned.

FIELD OF THE INVENTION

This invention relates to arrangements for holding a plurality of cans.

BACKGROUND OF THE INVENTION

Multipacks of cans are well known for drinks and foodstuffs. Cans of drinks, and indeed some foods, are often sold in multipacks utilizing a plastic ring having a number of apertures for receiving a corresponding number of cans. This number is often four or six. It is, however, desirable to cease using plastic in such multipacks.

SUMMARY OF THE INVENTION

According to the present invention there is provided an arrangement for holding a plurality of cans each of which has a top rim, said arrangement comprising a paperboard member having a plurality of apertures, each aperture being dimensioned so as to be marginally smaller than the widest dimensions of the top rim of a can to be held wherein each top rim and each associated aperture are pushed relative to each other so that the rim passes through the aperture which engages below the rim to prevent withdrawal of the can.

Preferably the apertures have their marginal portion upturned prior to coupling with the can. This upturning may be a process performed by the packing machinery itself or the process may be performed when the packing blank is originally stamped.

In preferred arrangements the paperboard member has side walls provided around the apertures which side walls are attached to the paperboard member along fold lines. In use, the side walls are folded down so as to engage the cans and are secured in the folded down positions. This results in space for printing. The side walls may be secured with glue or by interlocking formations formed integrally with the side walls. This securing may take place before or after attachment to the cans.

In most situations the apertures are substantially circular. Conveniently the apertures are formed in generally rectangular arrays such as 2×2 or 2×3 or 2×4 or even 1×2, 1×3, 1×4 or any other suitable configurations. Also finger gripping holes may be provided in the central space between each set of four apertures.

In another arrangement two oppositely extending side walls are hingedly attached to the paperboard member, the side walls being adapted to fold over the tops of the cans and secured to each other with, for example, glue.

BRIEF DESCRIPTION OF THE DRAWINGS

Embodiments of the invention will now be described in more detail. The description makes reference to the accompanying diagrammatic drawings.

DETAILED DESCRIPTION

Figure 1:
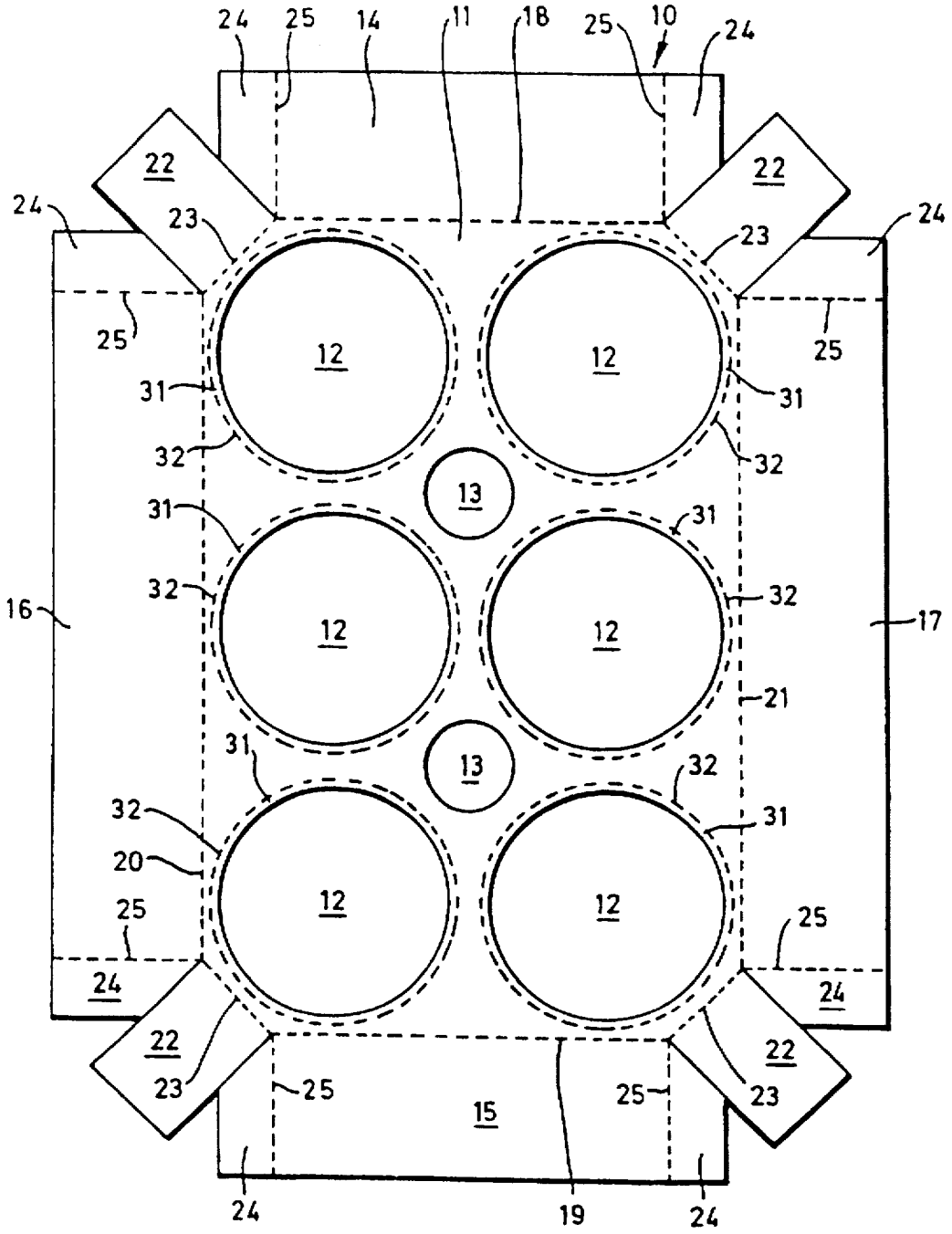
FIG. 1 is a plan view of a first embodiment of a blank for a holding arrangement according to the present invention.

In FIG. 1 there is shown a first paperboard blank 10 which has a top panel 11 in which are stamped apertures 12. The apertures 12 are circular and each has a diameter which is marginally less than the maximum diameter of the top rim of a can (not shown).

A marginal portion 31 surrounding each aperture 12 is upturned slightly along line 32 such that the marginal portions 31 are raised out of the general plane of the top panel 11. This upturn may be achieved by cold or hot forming of the blank. In some applications the can rims may require large marginal portions to be upturned and it may be preferable in such cases to use heat in the forming process. In the embodiments shown six apertures 12 are provided in a 2×3 rectangular array. Finger holes 13 are also provided, one at the center of each 2×2 sub-array of apertures 12.

A pair of side panels 14, 15, and a pair of front and rear panels 16, 17 are hingedly connected to the top panel 11 along fold lines 18, 19, 20, 21 respectively. Corner panels 22 are also hingedly connected to the top panel 11 along fold lines 23. Each panel 14, 15, 16, 17 is also formed with corner portions 24 at each end, which corner portions 24 are hingedly connected along fold lines 25.

In use the blank 10 will be stamped from a sheet of paperboard of suitable thickness. Also the fold lines are formed by scoring, perforating or any other known device or method. The blanks 10 can then be transported to the actual packing line.

Using the FIG. 1 blank 10, a set of six cans 35 (FIG. 3) will be arranged and the blank 10 will be positioned directly above the cans. The blank 10 will then be pressed over the can rims 36 (FIG. 3) which engage in their respective apertures 12. Some elastic deformation of the marginal portions 31 surrounding the apertures 12 occurs as the blank 10 is pressed over the rims of the cans, the upturns of the marginal portions 31 providing a lead-in for the cans and assisting the accurate location of the blank 10 on the cans. The marginal portions 31 then snap into position below the rims, tightly engaging the cans just below the rims. The side, front and rear panels 14–17 respectively are then folded down and the corner portions 24 are bent around the corner cans. Adhesive is applied to the underside of the corner panels 22 which are then folded down so as to adhere securely to the corner portions 24.

The result is a secure multipack of cans which resists removal of the cans.

When the blank 10 is pressed over the rims the marginal portions 31 surrounding the apertures 12 remain upturned slightly after the marginal portions 31 have snapped below the can rims. It will be appreciated that such upturned marginal portions 31 actively resist the cans being subsequently pulled out by downward pulling.

The forming of the marginal portions 31 may occur when the blank 10 is formed by using, for example, simple pressing techniques. Alternatively the forming could occur at the packaging area just prior to application to the cans.

The side, front and rear panels 14–17, respectively, result in a secure skirt which further prevents unwanted can movement relative to the paperboard holder and relative to other cans.

In a simpler arrangement (not shown) the panels 14–17, 22 are omitted and the cans are simply retained in the apertures 12 in the top panel 11.

Figure 2:
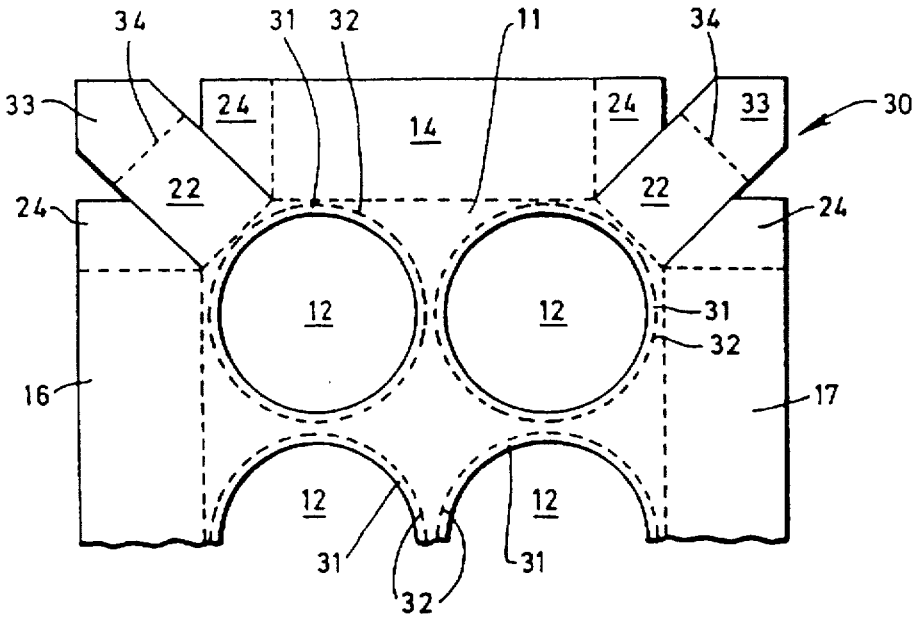
FIG. 2 is a partial plan view of a second embodiment of the blank according to the present invention.
Figure 3:
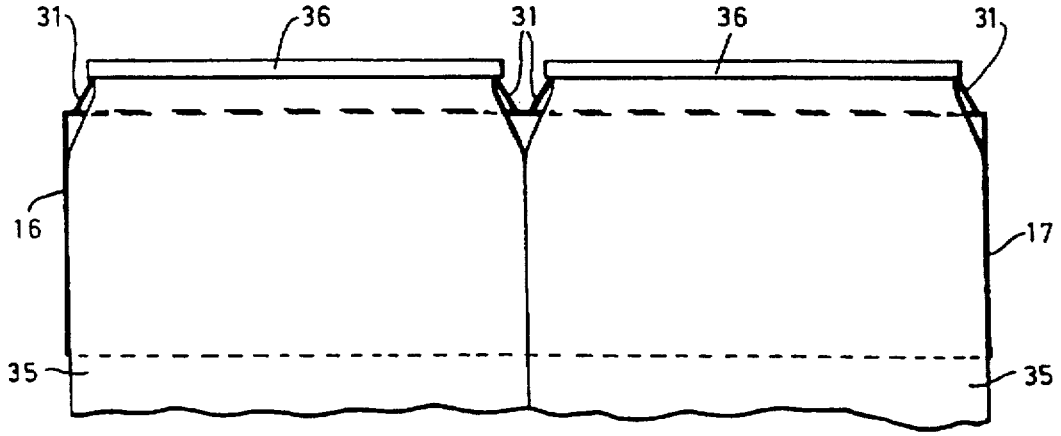
FIG. 3 is a part sectional side view through the FIG. 2 arrangement in use.

In the embodiment shown in FIGS. 2 and 3 many of the features of a second paperboard blank 30 are the same as those in FIG. 1 and so like parts have been given like reference numerals. In FIG. 2 the corner panels 22 are provided with extensions 33 which are hingedly connected along fold lines 34 and which, in use, are locked in any known way or adhered behind the corner portions 24 to provide greater rigidity.

In FIG. 3 blank 30 is shown assembled around cans 35 having top rims 36. The cans 35 are shown in side elevation but the blank 30 is shown in section.

Figure 4:
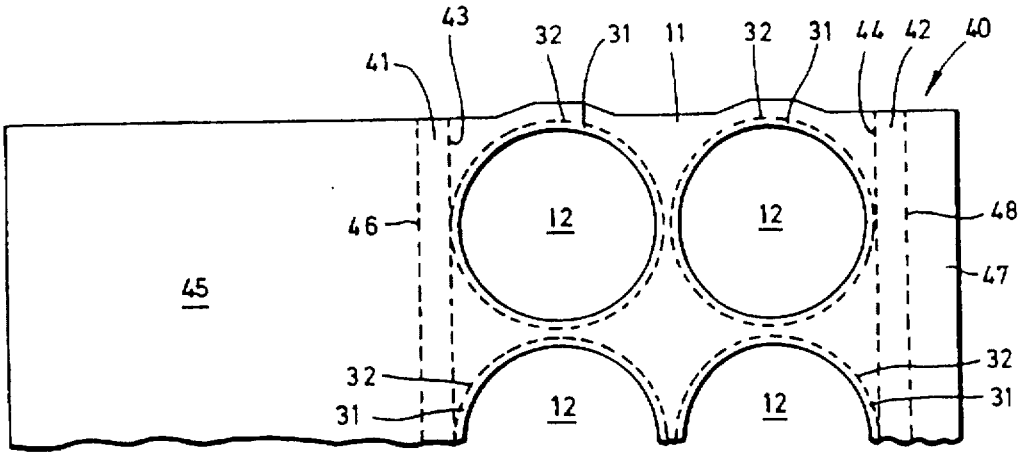
FIG. 4 is a partial view of a third embodiment of the blank of the present invention.
Figure 5:
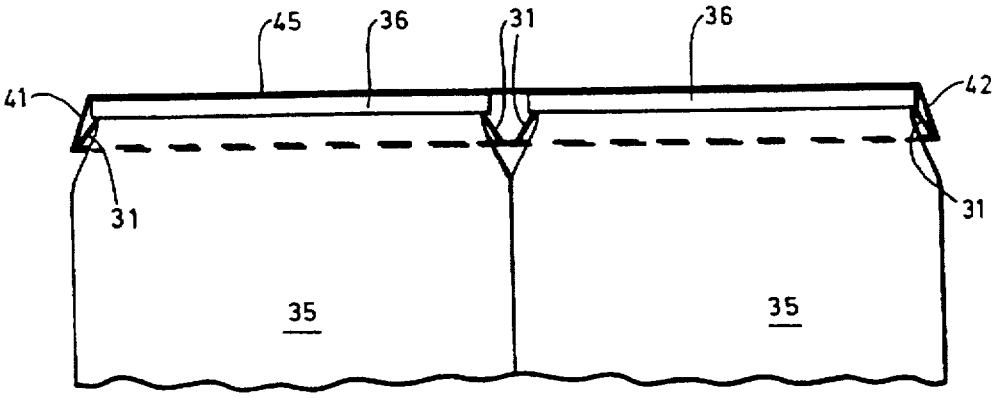
FIG. 5 is a part sectional side view through the blank of FIG. 4 in use.

A third paperboard blank 40 is shown in FIGS. 4 and 5 having features similar to those in FIGS. 1, 2, 3, which features have been given like reference numerals. In this embodiment left and right web panels 41, 42 are hingedly connected along fold lines 43, 44 to the top panel 11. A main overpanel 45 is hingedly connected along fold line 46 to web panel 41 and a secondary overpanel 47 is hingedly connected along fold line 48 to web panel 42.

When the blank 40 is being applied, the can rims 36 are pressed through the apertures 12 whereupon the web panels 41, 42 are folded upwards and then the overpanels 45, 47 are folded across the tops of the cans 35 and secured to each other using adhesive. This construction improves the rigidity of the multipack package.

It will be appreciated that the techniques described above are also suited to can rims/apertures 12 which are not round provided the can rim is a press fit in the aperture. The side skirts and/or top panels are optional features to help the rigidity of the package. They also provide more space for printing of words, logos, information, and the like.

The actual dimensions and characteristics of the marginal portion around the aperture are of course variable, and will be dependent largely on the can rim diameter, as well as the thickness and quality of the paperboard being used.

I claim:

1. A carrier device for holding a plurality of article containers together, said device comprising:

a generally rectangular top panel;

a plurality of spaced article container engaging apertures defined in said top panel and extending therethrough, each said aperture having a continuous marginal portion sized and shaped to be elastically deformed;

a front panel and a spaced and opposed rear panel hingedly connected to said top panel along a first pair of spaced and opposed hinge lines;

a pair of spaced and opposed side panels hingedly connected to said top panel along a second pair of spaced and opposed hinge lines;

said front panel, said rear panel, and each of said side panels having a corner portion hingedly connected to each one of the respective ends of each said panel along a corner portion fold line; and a corner panel hingedly connected to each of the corners of said top panel along a corner panel fold line, each said corner panel being positioned between one of said side panels and one of said front and rear panels, respectively;

wherein said front panel and said rear panel are constructed and arranged to be folded downwardly along one of said first pair of hinge lines, each of said side panels is constructed and arranged to be folded downwardly along one of said second pair of hinge lines, each of said corner portions is constructed and arranged to be folded along one of said corner portion fold lines towards each adjacent one of said corner portions, and each of said corner panels is constructed and arranged to be folded downwardly along a respective one of said corner panel fold lines and over each one of a pair of said corner portions at each corner of said top panel and fastened thereto for forming the carrier device at least partially about the article containers.

2. The carrier device of claim 1, wherein the marginal portion of each respective one of said apertures is constructed and arranged to extend away from said top panel as each said marginal portion is elastically deformed.

3. The carrier device of claim 1, wherein each said aperture is substantially circular.

4. The carrier device of claim 1, wherein each said corner panel is glued to each said pair of corner portions.

5. The carrier device of claim 1, said top panel further comprising at least one finger gripping hole defined therein for carrying said carrier device thereby.

6. The carrier device of claim 1, wherein said carrier device is constructed of paperboard.

7. The carrier device of claim 1, each said corner panel further comprising a corner panel extension hingedly connected thereto along an extension fold line.

8. The carrier device of claim 7, wherein said corner panel extension is constructed and arranged to be folded backward along said extension fold line into engagement with said pair of corner portions fastened underneath and by each said corner panel, respectively.

* * * * *